US011665468B2

(12) United States Patent
Bourgoin

(10) Patent No.: US 11,665,468 B2
(45) Date of Patent: May 30, 2023

(54) BASS REFLEX TYPE LOUDSPEAKER ENCLOSURE

(71) Applicant: SAGEMCOM BROADBAND SAS, Rueil-Malmaison (FR)

(72) Inventor: Gilles Bourgoin, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 241 days.

(21) Appl. No.: 16/768,772

(22) PCT Filed: Dec. 12, 2018

(86) PCT No.: PCT/EP2018/084503
§ 371 (c)(1),
(2) Date: Jun. 1, 2020

(87) PCT Pub. No.: WO2019/121213
PCT Pub. Date: Jun. 27, 2019

(65) Prior Publication Data

US 2020/0322715 A1 Oct. 8, 2020

(30) Foreign Application Priority Data

Dec. 19, 2017 (FR) ..... 17 62553

(51) Int. Cl.
*H04R 1/28* (2006.01)
*H04R 9/02* (2006.01)

(52) U.S. Cl.
CPC ..... *H04R 1/2819* (2013.01); *H04R 9/022* (2013.01); *H04R 2201/028* (2013.01)

(58) Field of Classification Search
CPC ..... H04R 1/025; H04R 1/08; H04R 1/403; H04R 1/02; H04R 1/028; H04R 1/345; H04R 1/2826; H04R 1/20; H04R 1/2819; H04R 1/2842; H04R 1/2834; H04R 1/227; H04R 1/2857; H04R 2201/021; H04R 2201/028; H04R 5/02; H04R 2205/021; H04R 2499/11; H04R 9/06; H04R 9/022;

(Continued)

(56) References Cited

U.S. PATENT DOCUMENTS 5,533,132 A * 7/1996 Button ..... H04R 1/028 381/87
6,944,024 B1 9/2005 Devine, III
10,104,761 B1 * 10/2018 MacDonald ..... H04R 1/025

(Continued)

FOREIGN PATENT DOCUMENTS

EP 1 581 025 A2 9/2005

*Primary Examiner* — Ahmad F. Matar
*Assistant Examiner* — Sabrina Diaz
(74) *Attorney, Agent, or Firm* — Muncy, Geissler, Olds & Lowe, P.C.

(57) ABSTRACT

Bass reflex type loudspeaker enclosure comprising a cabinet, a loudspeaker and a first vent. The acoustic loudspeaker enclosure further comprises a second vent and an internal heat sink which is located inside the cabinet and intended to be thermally coupled to an electrical component in order to dissipate, inside the cabinet, heat produced by the electrical component, the first vent, the second vent and the internal heat sink being positioned so that an air flow which flows through the first vent, the second vent and into the cabinet moves the heat produced by the electrical component out of the cabinet.

14 Claims, 5 Drawing Sheets

(58) Field of Classification Search
CPC ..... H04R 9/025; H04R 9/045; B60R 11/0217; B60R 2011/0045; H04S 7/40; H04S 1/002
USPC ..... 381/87, 332, 334, 349, 345, 337, 397; 181/156
See application file for complete search history.

(56) References Cited

U.S. PATENT DOCUMENTS

2005/0211498 A1* 9/2005 Osada ..... H04R 9/022 181/156
2013/0213730 A1* 8/2013 Litovsky ..... H04R 1/02 181/199

* cited by examiner

BASS REFLEX TYPE LOUDSPEAKER ENCLOSURE

The invention relates to the field of bass reflex type loudspeaker enclosures.

BACKGROUND OF THE INVENTION

Much modern electrical equipment incorporates a loudspeaker enclosure for playing back an audio signal. Such electrical equipment includes in particular residential gateways, set-top boxes, TV sets, voice assistants, etc.

A loudspeaker enclosure in that type of electrical equipment conventionally comprises a cabinet and a loudspeaker fastened to the cabinet. The loudspeaker plays back the audio signal by generating sound waves propagating from the cabinet. The loudspeaker produces the sound waves from an electric current that is applied to a coil of the loudspeaker by an audio amplifier.

The low-frequency performance of the loudspeaker enclosure can be improved by adding a vent in the cabinet. The enclosure is then said to be of the "bass reflex" type. The air passing through the vent between the inside volume of the cabinet (behind the loudspeaker) and the outside space (in front of the loudspeaker) forms a mechanical system that resonates at a specific frequency.

Naturally, efforts are made to reduce the cost and the size of such electrical equipment.

OBJECT OF THE INVENTION

An object of the invention is to reduce the cost and the size of electrical equipment of the kind described above.

SUMMARY OF THE INVENTION

In order to achieve this object, there is provided a loudspeaker enclosure of the bass reflex type comprising a cabinet, a loudspeaker, and a first vent, the loudspeaker enclosure being characterized in that it further comprises a second vent and an internal heatsink situated inside the cabinet and for being thermally coupled with an electrical component in order to dissipate, inside the cabinet, heat produced by the electrical component; the first vent, the second vent, and the internal heatsink being positioned in such a manner that a flow of air passing through the first vent, the second vent, and inside the cabinet exhausts the heat produced by the electrical component to outside the cabinet.

The internal heatsink is positioned inside the cabinet. This limits the total volume required for the functions both of cooling of the electrical component and also of playing back sound. This serves to reduce the overall size of the electrical equipment incorporating the loudspeaker enclosure of the invention.

Since a flow of air passes naturally through the inside of the cabinet via the first and second vents, it is not essential to use a fan in order to improve cooling. This serves to reduce the cost of the electrical equipment incorporating the loudspeaker enclosure of the invention.

There is also provided an acoustic device comprising a loudspeaker enclosure as described above and a printed circuit board having the electrical component mounted thereon.

There is also provided electrical equipment comprising a loudspeaker device as described above.

Other characteristics and advantages of the invention appear on reading the following description of particular, nonlimiting embodiments of the invention.

BRIEF DESCRIPTION OF THE DRAWINGS

Reference is made to the accompanying drawings, in which.

DETAILED DESCRIPTION OF THE INVENTION

Figure 1:
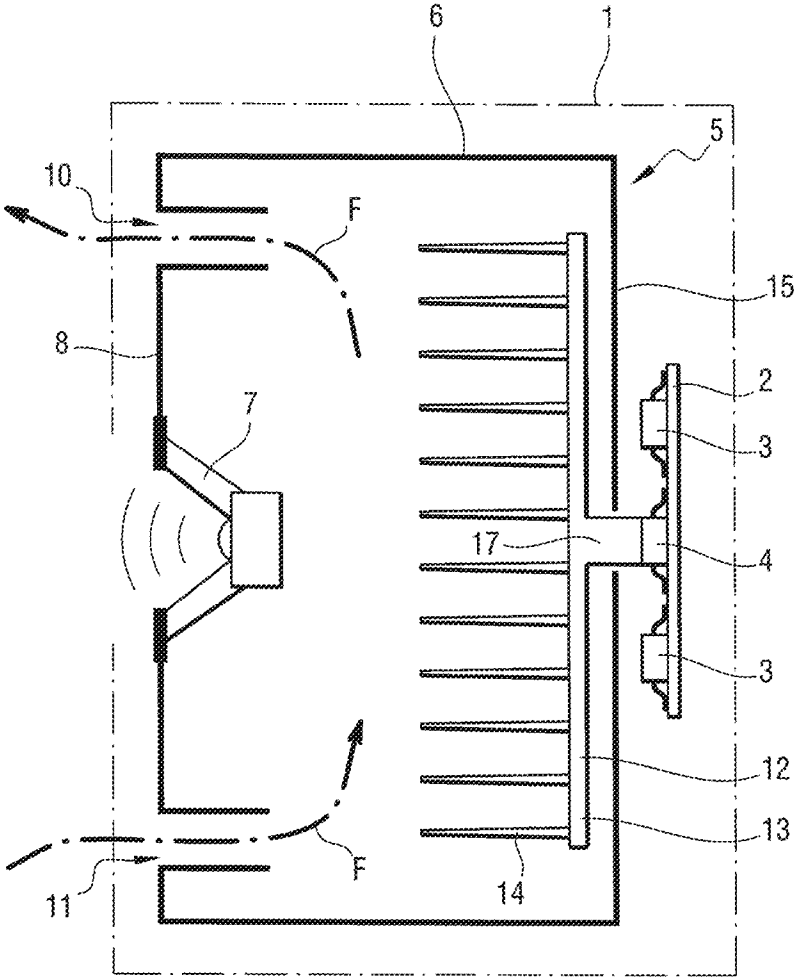
FIG. 1 shows a loudspeaker enclosure in a first embodiment of the invention.

With reference to FIG. 1 and in this example, the invention is implemented in a residential gateway 1.

The residential gateway 1 includes a printed circuit board 2 carrying a plurality of electrical components 3 forming part of an audio amplifier (i.e. the electrical components 3 contribute to performing an audio amplifier function). The audio amplifier produces electric current used for reproducing an audio signal.

Among the electrical components 3, the electrical component 4 is the electrical component that generates the most heat.

In a first embodiment of the invention, the residential gateway 1 also includes a loudspeaker enclosure 5.

The loudspeaker enclosure 5 comprises a cabinet 6 defining an internal cavity of defined volume, and a loudspeaker 7. The loudspeaker 7 is situated on a first face 8 of the cabinet 6, which in this example is a front face of the cabinet 6.

The loudspeaker 7 includes a coil. The electric current produced by the audio amplifier passes through the coil of the loudspeaker 7 so that the loudspeaker 7 generates sound waves, thereby playing back the audio signal.

The loudspeaker enclosure 5 also includes a first vent 10 and a second vent 11.

The first vent 10 is situated in the proximity of a first end of the first face 8. The first end is a top end. The second vent 11 is situated in the proximity of a second end of the first face 8. The second end is a bottom end. The term "in the proximity of" is used to mean that a maximum distance between a vent and an end of the face is less than one third of the total length of the face.

The first vent 10 extends horizontally from the first face 8 into the inside of the cabinet 6. The second vent 11 extends horizontally from the first face 8 into the inside of the cabinet 6.

Naturally, the terms "top", "bottom", "horizontally", and "vertically" are to be interpreted in a configuration in which the loudspeaker enclosure 5 is positioned in a nominal utilization position.

In this example, the loudspeaker 7 is positioned between the first vent 10 and the second vent 11.

The positions and the dimensions of the first vent 10 and of the second vent 11 are selected to enable air to pass naturally inside the loudspeaker enclosure 5, such that a flow F of air passes naturally through the second vent 11, inside the cabinet 6, and through the first vent 10. The direction of the air flow F could naturally be different from that shown in FIG. 1.

The positions and the dimensions of the first vent 10 and of the second vent 11 are also selected to optimize the acoustic performance of the loudspeaker enclosure 5, in particular at low frequencies.

The dimensions of the first vent 10 and of the second vent 11, both of which are of the "bass reflex" type, are determined by using the definition of a Helmholtz resonator for each vent.

Thus, for each vent:

$$(\Delta/2)^2=(L+k\cdot Ø)\cdot V/S,$$

where λ is the wavelength of the resonant frequency of the vent, L is the length of the vent, Ø is the diameter of the vent, V is the volume defined in the internal cavity of the cabinet 6, and S is the section of the vent. The coefficient k is a coefficient representative of the discontinuity states of the ends of the vent. The coefficient k tends towards 0.5 if a vent termination is flared. The coefficient k tends towards 1 if a vent termination is flush.

Also:

λ=c/F, where F is the wavelength at the resonant frequency and c is the speed of sound.

For example, in order to have a "bass reflex" resonator at 100 hertz (Hz) in a loudspeaker enclosure 5 presenting a defined volume of 3 liters (L), the first vent 10 and the second vent 11 may have dimensions such that each of them presents a diameter of 4 centimeters (cm) and a length of 13 cm.

The loudspeaker enclosure 5 also includes an internal heatsink 12, specifically a finned heatsink. The internal heatsink 12 includes a baseplate 13 and a plurality of fins 14 extending from the baseplate 13, perpendicularly to the baseplate 13.

When the internal heatsink 12 is mounted in the cabinet 6, the internal heatsink 12 extends in the proximity of a second face 15 of the cabinet 6 that is situated facing the first face 8. Thus in this example the second face 15 is a rear face of the cabinet 6.

The baseplate 13 of the internal heatsink 12 extends parallel to and is fastened to an inside wall of the second face 15. The term "wall" is used herein to mean one of the sides of a face. The fins 14 of the internal heatsink 12 then extend towards the inside of the cabinet 6.

The printed circuit board 2 of the residential gateway 1 is located outside the cabinet 6 of the loudspeaker enclosure 5. The printed circuit board 2 is positioned parallel to an outside wall of the second face 15 of the cabinet 6 of the loudspeaker enclosure 5.

The baseplate 13 of the internal heatsink 12 is thermally coupled to the electrical component 4 of the printed circuit board 2.

In order to provide the thermal coupling, the internal heatsink 12 has a metal stud 17 that extends from the baseplate 13 of the internal heatsink 12 from its side opposite from the fins 14. When the internal heatsink 12 is installed in the cabinet 6, the metal stud 17 extends through the second face 15 of the cabinet 6. When the loudspeaker enclosure 5 and the printed circuit board 2 are incorporated in the residential gateway 1, the electrical component 4 is in contact with the metal stud 17. Thus, in this example, the thermal coupling is by direct contact.

Thus, the heat produced by the electrical component 4 is dissipated by the internal heatsink 12 inside the cabinet 6. The air flow F, which also passes along the internal heatsink 12 and over the fins 14 of the internal heatsink 12, exhausts the heat produced by the electrical component 4 towards the outside of the cabinet 6.

Figure 2:
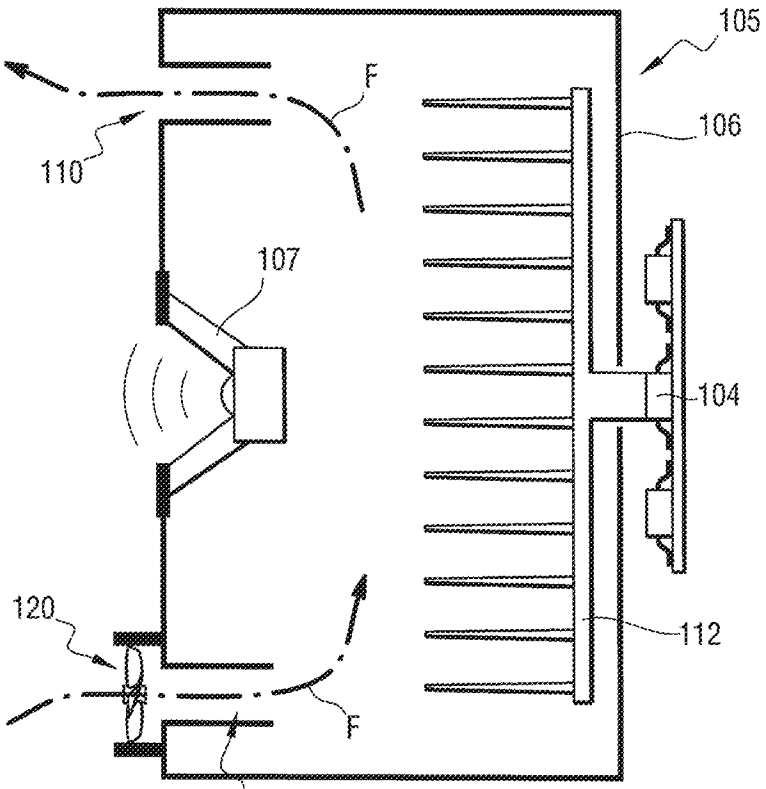
FIG. 2 shows a loudspeaker enclosure in a second embodiment of the invention.

With reference to FIG. 2, a loudspeaker enclosure 105 in a second embodiment of the invention includes a fan 120. The fan 120 is positioned outside the loudspeaker enclosure 105, at an inlet of the second vent 111. The fan 120 extends facing the inlet of the second vent 111. The term "inlet" used herein to mean the orifice of a vent that opens to the outside of the cabinet 106, and the term "outlet" is used herein to mean the orifice of a vent that opens to the inside of the cabinet 106.

The fan 120 is an axial propeller fan. The static pressure of the fan 120 is relatively small, and for example it is less than 20 pascals (Pa) or 30 Pa. The fan can thus be mounted directly at the inlet of the second vent 111, and it could equally well be mounted at an outlet of the second vent 111, or indeed inside the second vent 111.

It is possible to select a fan of some other type, and in particular a turbine fan having greater static pressure, e.g. of the order of 100 Pa or 150 Pa. Under such circumstances, the fan 120 should be spaced apart from the second vent 111 by a few millimeters (mm), e.g. in the range 5 mm to 10 mm in order to avoid disturbing the performance of the second vent 111, while still performing its function of stirring air.

The fan 120 is selected on the basis of acoustic criteria. The fan 120 is silent and balanced. The fan 120 does not generate vibration in the structure of the loudspeaker enclosure 105, and it does not interfere with the primary function of the loudspeaker enclosure 105, which is to play back an audio signal.

The fan 120 is mounted via a damper device that is incorporated in the fan 120 and is situated between the body of the fan 120 and the cabinet 106. Such flexible mounting serves to limit the transmission of residual vibration produced by the fan 120. The fan 120 could also be mounted rigidly while taking certain precautions to avoid transmitting vibration.

The dimensions of the second vent 111 must naturally be compatible with the dimensions of the fan 120. In this example, the diameter of the fan 120 is greater than the diameter of the second vent 111.

The fan 120 serves to improve the thermal performance of the loudspeaker enclosure 105. The fan 120 forces air to pass through the second vent 111, inside the cabinet 106, and through the first vent 110, and also along the internal heatsink 112. The air flow F is thus greater and the heat produced by the electrical component 104 is exhausted to the outside of the cabinet 106 of the loudspeaker enclosure 105 in more effective manner.

It should be observed that the low extra pressure generated by the fan may be considered as a continuous load that is negligible for the loudspeaker 107, for the first vent 110, or for the second vent 111. This continuous load does not impede the operation of the loudspeaker 107, of the first vent 110, and of the second vent 111.

It should be observed that the fan 120 could also be mounted at the inlet, at the outlet, or inside the first vent 110.

Figure 3:
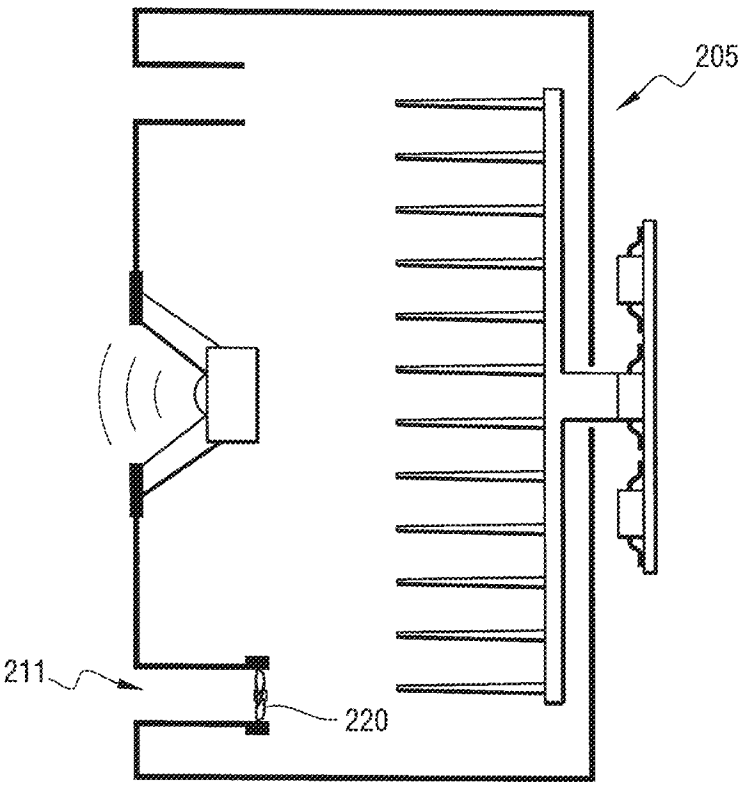
FIG. 3 shows a loudspeaker enclosure in a third embodiment of the invention.

With reference to FIG. 3, a loudspeaker enclosure 205 in a third embodiment of the invention includes a fan 220. The fan 220 is positioned inside the loudspeaker enclosure 205, at an outlet of the second vent 211. The diameter of the fan 220 is close to the diameter of the second vent 211 (but it could be greater or smaller).

Figure 4:
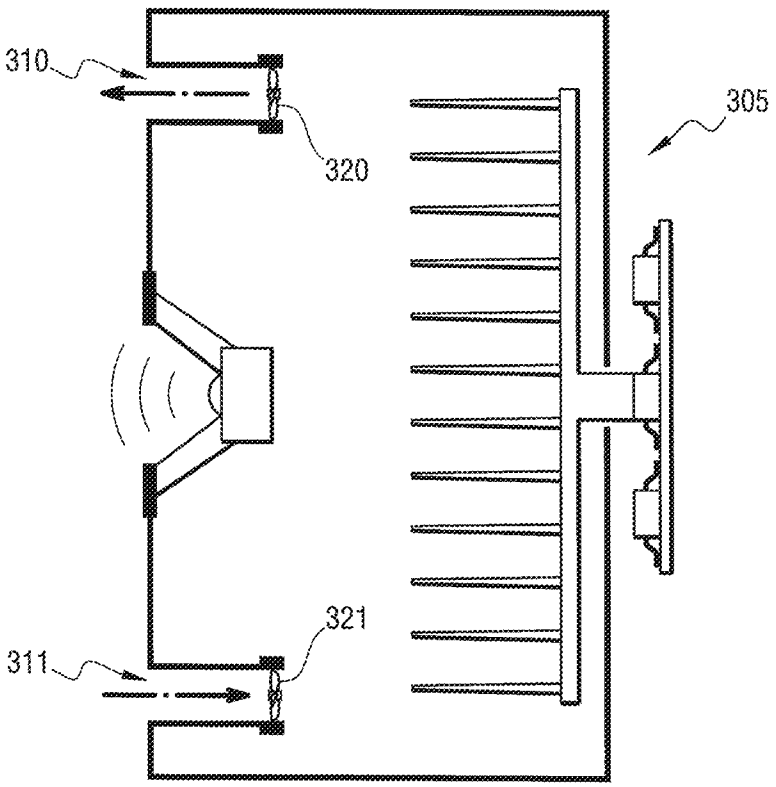
FIG. 4 shows a loudspeaker enclosure in a fourth embodiment of the invention.

With reference to FIG. 4, a loudspeaker enclosure 305 in a fourth embodiment of the invention includes a first fan 320 and a second fan 321. The first fan 320 is positioned inside the loudspeaker enclosure 305, at an outlet of the first vent 310. The second fan 321 is positioned inside the loudspeaker enclosure 305, at an outlet of the second vent 311.

Figure 5:
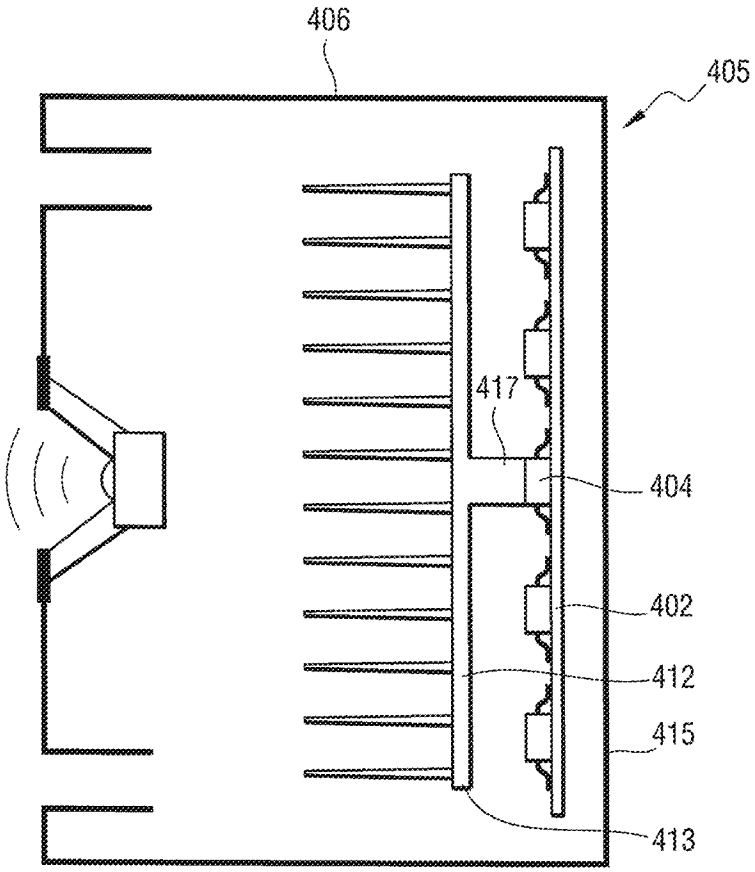
FIG. 5 shows a loudspeaker enclosure in a fifth embodiment of the invention.

With reference to FIG. 5, it can be seen, in a fifth embodiment 405 of the invention, that it is possible to position the printed circuit board 402 inside the cabinet 406 of the loudspeaker enclosure.

The printed circuit board 402 extends parallel to and is fastened to the inside wall of the second face 415 (rear face). The baseplate 413 of the internal heatsink 412 extends parallel to and is fastened to an inside wall of the second face 415. The printed circuit board 402 is positioned between the baseplate 413 of the internal heatsink 412 and the inside wall of the second face 415. The metal stud 417 is in contact with the electrical component 404.

This configuration further improves incorporation of the loudspeaker enclosure 405 containing the internal heatsink 412 and the printed circuit board 402, and reduces the total volume needed by the loudspeaker enclosure 405 containing the internal heatsink 412 and by the printed circuit board 402.

Naturally, it would be possible to add one or more fans to the loudspeaker enclosure 405 in positions as described above.

Figure 6:
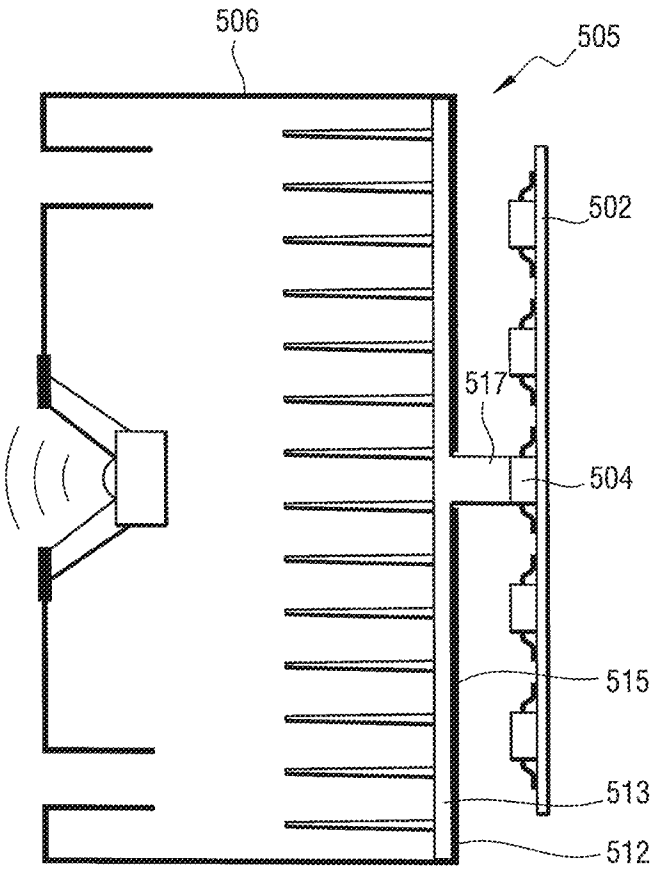
FIG. 6 shows a loudspeaker enclosure in a sixth embodiment of the invention.

With reference to FIG. 6, the internal heatsink 512 of a loudspeaker enclosure 505 in a sixth embodiment of the invention is incorporated in the structure of the loudspeaker enclosure 505.

A plane surface of the internal heatsink 512 forms at least a portion of an outside wall of a face of the cabinet 506. In this example, specifically, this plane surface is a surface of the baseplate 513 of the internal heatsink 512. The baseplate 513 forms the entire second face (rear face) 515 of the cabinet 506 of the loudspeaker enclosure 505.

The printed circuit board 502 then extends outside the cabinet 506 of the loudspeaker enclosure 505, parallel to the second face 515 of the cabinet 506. The metal stud 517 of the internal heatsink 512 is in contact with the electrical component 504.

The baseplate 513 of the internal heatsink 512 and the rear face of the cabinet 506 thus coincide. This reduces the weight and the total cost of the loudspeaker enclosure 505, which performs the functions both of playing back the audio signal and also of dissipating heat, and thus reduces the weight and the cost of the residential gateway in which the loudspeaker enclosure 505 is incorporated.

Figure 8:
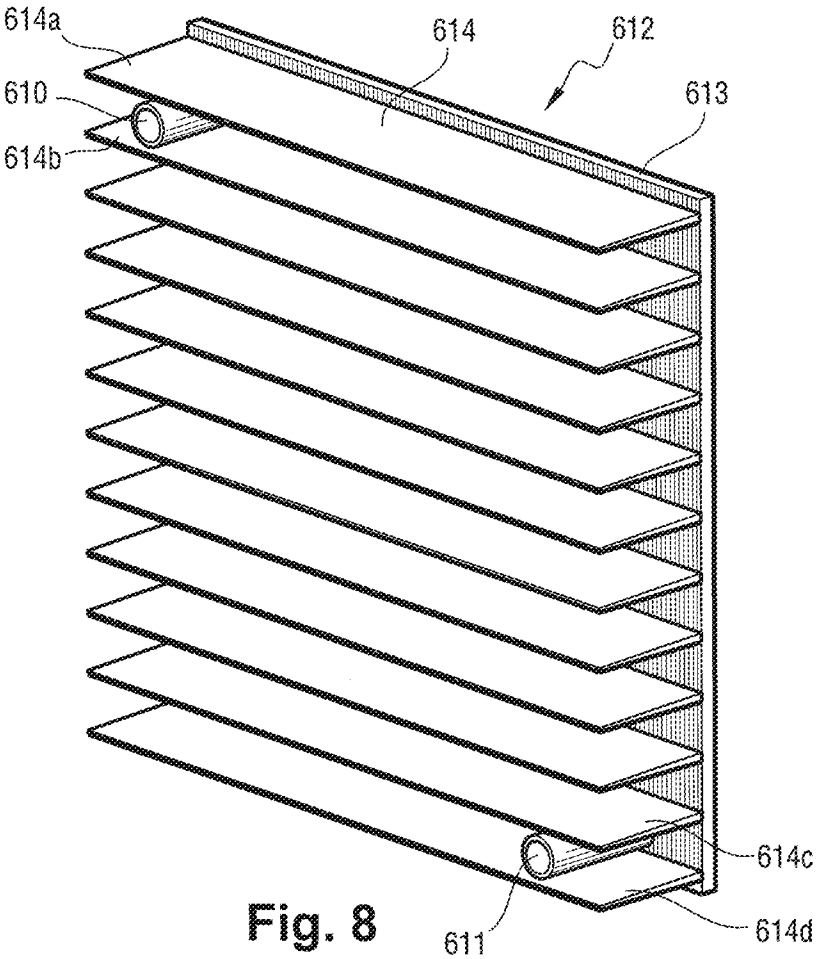
FIG. 8 shows an internal heatsink of the loudspeaker enclosure of the seventh embodiment of the invention.
Figure 7:
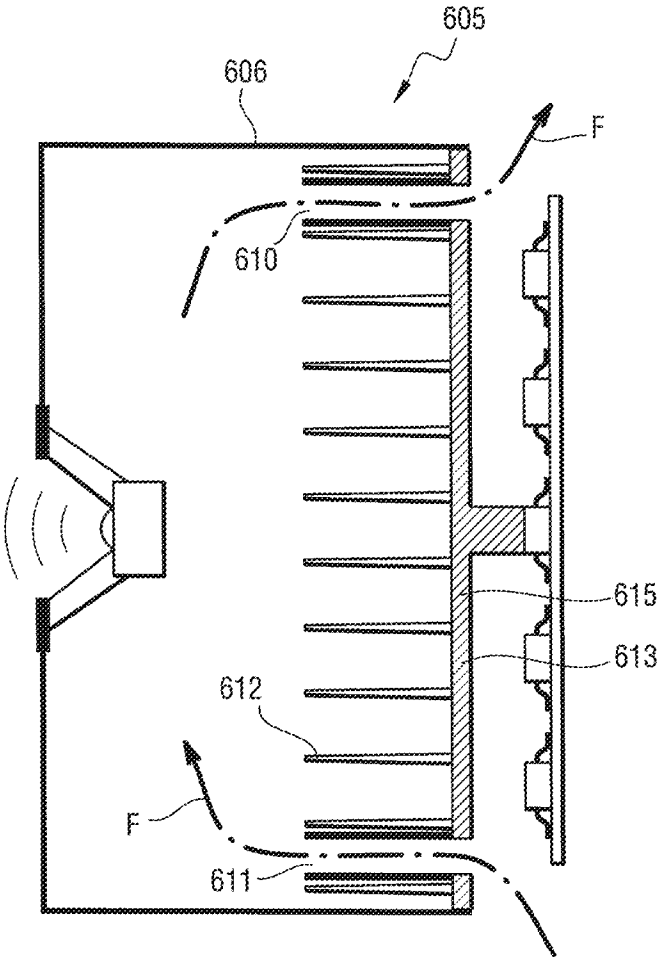
FIG. 7 shows a loudspeaker enclosure in a seventh embodiment of the invention.

With reference to FIGS. 7 and 8, the internal heatsink 612 is once more incorporated in the structure of the loudspeaker enclosure 605 in a seventh embodiment of the invention. The baseplate 613 of the internal heatsink 612 once more forms the entire second face (rear face) 615 of the cabinet 606 of the loudspeaker enclosure 605.

The first vent 610 and the second vent 611 are incorporated in the internal heatsink 612. The first vent 610 and the second vent 611 thus extend inside the cabinet 606 from the second face 615 of the cabinet 606.

Each of the first and second vents 610 and 611 is constituted by a cylinder that extends at least in part inside the internal heatsink 612. The cylinder forming the first vent 610 extends between two fins 614*a* and 614*b*. The cylinder forming the second vent 611 extends between two fins 614*c* and 614*d*. Each cylinder has its axis perpendicular to the baseplate 613 of the internal heatsink 612 and parallel to the planes in which the fins 614 extend. It should be observed that the cylinders extend between two different pairs of fins, which is one possibility, but not essential. By way of example, it is also possible to envisage that the axis of a vent corresponds with the axis of a fin.

In this example, the first vent 610, the second vent 611, and the internal heatsink 612 form a single part. By way of example, this single part may be made entirely or partially out of metal or out of a thermally conductive plastics material, e.g. out of polyimide.

Figure 9:
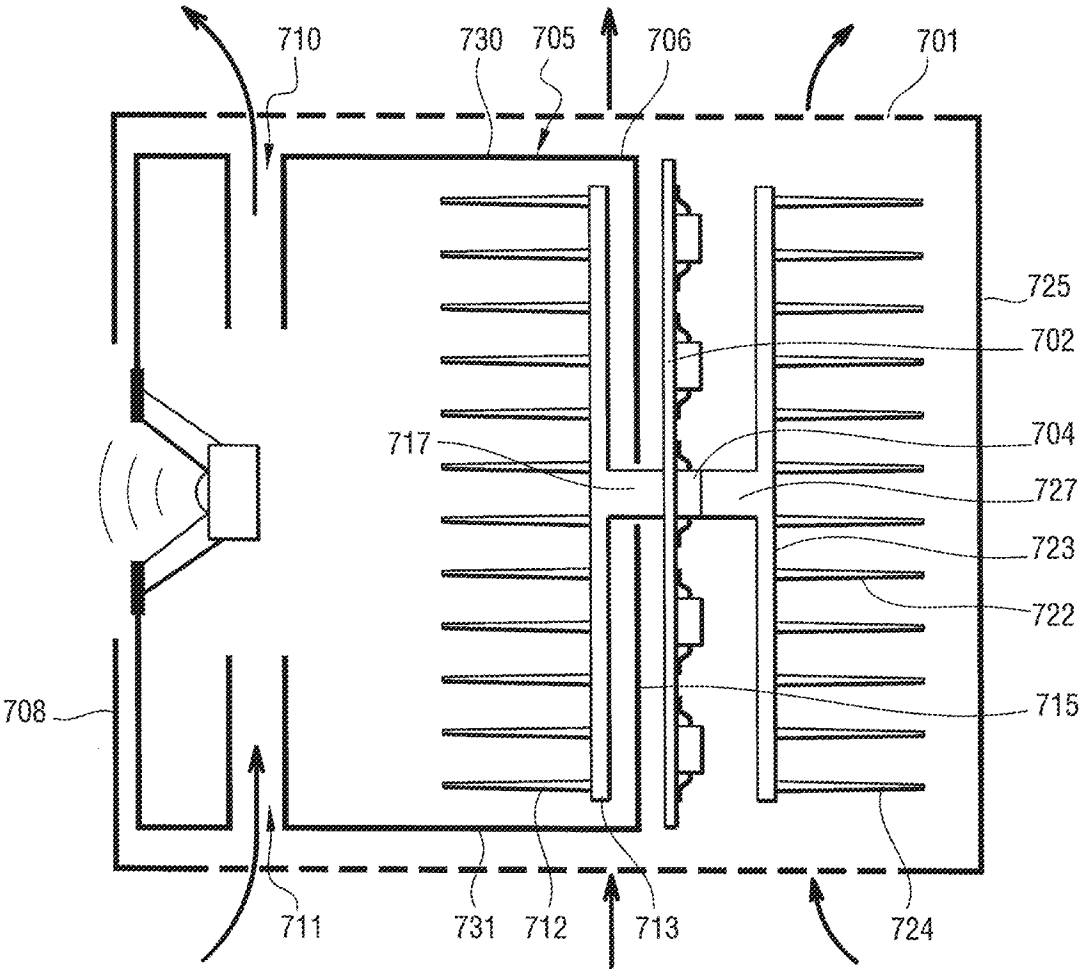
FIG. 9 shows a loudspeaker enclosure in an eighth embodiment of the invention.

With reference to FIG. 9, and in an eighth embodiment of the invention, a casing of a residential gateway 701 includes a loudspeaker enclosure 705. The loudspeaker enclosure 705 includes an internal heatsink 712. The residential gateway 701 further includes an external heatsink 722 positioned outside the loudspeaker enclosure 705.

The internal heatsink 712 and the external heatsink 722 are both finned heatsinks, similar to those described above.

The internal heatsink 712 is positioned inside the cabinet 706. The baseplate 713 of the internal heatsink 712 is mounted against the inside wall of the second face 715 of the cabinet 706. The printed circuit board 702 extends parallel to the outside wall of the second face (rear face) 715 of the cabinet 706, outside the cabinet 706.

The external heatsink 722 is positioned outside the cabinet 706. A baseplate 723 of the external heatsink 722 extends parallel to the outside wall of the second face 715 of the cabinet 706. Fins 724 of the external heatsink 722 extend from the baseplate 723, perpendicularly to the baseplate 723, towards a face 725 of the casing of the residential gateway 701 situated opposite from the first face (front face) 708 of the loudspeaker enclosure 705 (and of the residential gateway 701).

The external heatsink 722 is also thermally coupled with the electrical component 704. For this purpose, the external heatsink 722 includes a metal stud 727 that comes into contact with the electrical component 704. The metal stud 717 of the internal heatsink 712 comes into contact with a surface of the printed circuit of the printed circuit board 702 that extends under the electronic component 704.

It should be observed that the first vent 710 is once more situated in the proximity of the first end of the first face 708, and that the second vent 711 is once more situated in the proximity of the second end of the first face 708.

However, the first vent 710 now extends vertically inside the cabinet from a third face 730. The third face is a top face of the cabinet 706.

Likewise, the second vent 711 extends vertically inside the cabinet, from a fourth face 731. The fourth face is a bottom face of the cabinet 706.

Naturally, the invention is not limited to the embodiments described, but covers any variant coming within the ambit of the invention as defined by the claims.

Above, the thermal coupling between each heatsink and an electrical component is described as direct contact via a metal stud. The thermal coupling could be indirect coupling, e.g. coupling via a thermally conductive component, which may optionally be springy.

Although the first vent and the second vent are described above as extending inside the cabinet, one or both of the vents could perfectly well extend outside the cabinet, or could extend in part inside and in part outside the cabinet.

It is also possible for only one of the two vents to extend horizontally, and only one of the two vents to extend vertically.

Above, the internal heatsink and the external heatsink are described as being arranged to cool the same electrical component. Naturally, the internal heatsink could perfectly well cool a first electrical component and the external heatsink could cool a second electrical component. By way of example, the second electrical component could be situated on the same printed circuit board, but on another face, or it could be situated on another printed circuit board.

Naturally, the internal (and/or external) heatsink could cool not only one electrical component, but a plurality of electrical components. The electrical component(s) thermally coupled with the internal (and/or external) heatsink need not necessarily form part of an audio amplifier: the component may be any type of electrical component that becomes hot in operation, and for example it could be a processor, a radio transmitter, etc.

The first vent could be situated through any face of the cabinet. Preferably, the end of the first vent is situated high up so as to exhaust hot air. Likewise, The second vent could be situated through any face of the cabinet. Preferably, the end of the second vent is situated low down so as to enable cool air to enter.

It is stated above that the first vent is situated in the proximity of a first end of the first face, that the second vent is situated in the proximity of a second end of the first face, and that the first end is a top end and the second end is a bottom end. Other configurations could be devised. Thus, by way of example, if the first face including the loudspeaker is a top face, the first end of could be a left end and the second end could be a right end of the first face.

The invention claimed is:

1. A loudspeaker enclosure of the bass reflex type comprising a cabinet, a loudspeaker, and a first vent, the loudspeaker enclosure being characterized in that it further comprises a second vent and an internal heatsink situated inside the cabinet and for being thermally coupled with a first electrical component in order to dissipate, inside the cabinet, heat produced by the first electrical component; the first vent, the second vent, and the internal heatsink being positioned in such a manner that a flow of air passing through the first vent, the second vent, and inside the cabinet exhausts the heat produced by the first electrical component to outside the cabinet, a plane surface of the internal heatsink forming a portion of an outside wall of a face of the cabinet, the first vent and/or the second vent extending at least in part within the internal heatsink, the internal heatsink being a finned heatsink, and each of the first and second vents extending between two fins of the internal heatsink.

2. The loudspeaker enclosure according to claim 1, wherein the first vent and/or the second vent extend(s) horizontally inside the cabinet.

3. The loudspeaker enclosure according to claim 1, wherein the first vent and/or the second vent extend(s) vertically inside the cabinet.

4. The loudspeaker enclosure according to claim 1, further including at least one fan positioned at an inlet or at an outlet of the first vent or of the second vent.

5. The loudspeaker enclosure according to claim 1, wherein the first vent, the second vent, and the internal heatsink form a single part.

6. Acoustic device comprising a loudspeaker enclosure according to claim 1, and a printed circuit board on which the first electrical component is mounted.

7. The acoustic device according to claim 6, wherein the printed circuit board is situated inside the cabinet.

8. The acoustic device according to claim 6, wherein the printed circuit board is situated outside the cabinet.

9. The acoustic device according to claim 6, wherein the first electrical component forms part of an audio amplifier.

10. The acoustic device according to claim 6, further comprising an external heatsink positioned outside the loudspeaker enclosure.

11. The acoustic device according to claim 10, the external heatsink being thermally coupled with a second electrical component.

12. The acoustic device according to claim 11, the second electrical component and the first electrical component being one and the same electrical component.

13. Electrical equipment comprising an acoustic device according to claim 10.

14. The electrical equipment according to claim 13, the electrical equipment being a residential gateway or a set-top box or a TV set or a voice assistant.

* * * * *